US009975164B2

(12) United States Patent
Carstens et al.

(10) Patent No.: US 9,975,164 B2
(45) Date of Patent: May 22, 2018

(54) CONTAINER, AND SELECTIVELY FORMED SHELL, AND TOOLING AND ASSOCIATED METHOD FOR PROVIDING SAME

(71) Applicant: Stolle Machinery Company, LLC, Centennial, CO (US)

(72) Inventors: Aaron E. Carstens, Centerville, OH (US); James A. McClung, N.E. Canton, OH (US); Paul L. Ripple, N.E. Canton, OH (US); Gregory H. Butcher, Columbus, OH (US); Patrick K. McCarty, Dayton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 84 days.

(21) Appl. No.: 14/722,187

(22) Filed: May 27, 2015

(65) Prior Publication Data

US 2015/0251237 A1 Sep. 10, 2015

Related U.S. Application Data

(63) Continuation-in-part of application No. 13/894,017, filed on May 14, 2013, now Pat. No. 9,573,183.
(Continued)

(51) Int. Cl.

| | |
|---|---|
| ***B21D 37/10*** | (2006.01) |
| ***B21D 22/24*** | (2006.01) |
| ***B21D 51/38*** | (2006.01) |

(52) U.S. Cl.
CPC ..... *B21D 37/10* (2013.01); *B21D 22/24* (2013.01); *B21D 51/38* (2013.01); *Y10T 428/12389* (2015.01)

(58) Field of Classification Search
CPC .... B21D 51/2653; B21D 51/26; B21D 51/44; B21D 51/38; B21D 22/24; B21D 22/20; Y10T 428/12389
See application file for complete search history.

(56) References Cited

U.S. PATENT DOCUMENTS

| | | | |
|---|---|---|---|
| 3,957,005 | A | 5/1976 | Heffner |
| 3,979,009 | A | 9/1976 | Walker |

(Continued)

FOREIGN PATENT DOCUMENTS

| | | | |
|---|---|---|---|
| DE | 29906170 | U1 | 10/1999 |
| EP | 0497346 | A1 | 1/1992 |

(Continued)

OTHER PUBLICATIONS

Stolle Machinery Company, LLC, PCT/US2016/026312 International Search Report, dated Jul. 7, 2016, 19 pages.

(Continued)

*Primary Examiner* — Peter DungBa Vo
*Assistant Examiner* — John S Lowe
(74) *Attorney, Agent, or Firm* — Eckert Seamans Cherin & Mellott, LLC; David C. Jenkins

(57) ABSTRACT

A shell, a container employing the shell, and tooling and associated methods for forming the shell are provided. The shell includes a center panel, a circumferential chuck wall, an annular countersink between the center panel and the circumferential chuck wall, and a curl extending radially outwardly from the chuck wall. The material of at least one predetermined portion of the shell is selectively stretched relative to at least one other portion of the shell, thereby providing a corresponding thinned portion. The tooling includes a pressure concentrating forming surface.

10 Claims, 10 Drawing Sheets

Related U.S. Application Data

(60) Provisional application No. 61/648,698, filed on May 18, 2012.

(56) References Cited

U.S. PATENT DOCUMENTS

| | | | | |
|---|---|---|---|---|
| 4,020,670 | A | | 5/1977 | Bulso, Jr. et al. |
| 4,214,471 | A | | 7/1980 | Bulso, Jr. et al. |
| 4,248,076 | A | | 2/1981 | Bulso, Jr. et al. |
| 4,341,321 | A | | 7/1982 | Gombas |
| 4,343,173 | A | | 8/1982 | Bulso, Jr. et al. |
| 4,372,143 | A | | 2/1983 | Elert et al. |
| 4,416,140 | A | | 11/1983 | Bulso, Jr. et al. |
| 4,454,743 | A | | 6/1984 | Bulso, Jr. et al. |
| 4,483,172 | A | | 11/1984 | Bulso, Jr. et al. |
| 4,535,618 | A | | 8/1985 | Bulso, Jr. et al. |
| 4,574,608 | A | | 3/1986 | Bulso, Jr. et al. |
| 4,587,825 | A | | 5/1986 | Bulso, Jr. et al. |
| 4,587,826 | A | | 5/1986 | Bulso, Jr. et al. |
| 4,696,177 | A | | 9/1987 | Bulso, Jr. et al. |
| 4,713,958 | A | | 11/1987 | Bulso, Jr. et al. |
| 4,715,208 | A | | 12/1987 | Bulso, Jr. et al. |
| 4,716,755 | A | | 1/1988 | Bulso, Jr. et al. |
| 4,722,215 | A | * | 2/1988 | Taube ..... B21D 22/30 413/76 |
| 4,723,433 | A | | 2/1988 | Grims |
| 4,732,031 | A | | 3/1988 | Bulso, Jr. et al. |
| 4,800,743 | A | | 1/1989 | Bulso, Jr. et al. |
| 4,808,052 | A | | 2/1989 | Bulso, Jr. et al. |
| 4,826,382 | A | | 5/1989 | Bulso, Jr. et al. |
| 5,024,077 | A | | 6/1991 | Bulso, Jr. et al. |
| 5,218,849 | A | | 6/1993 | Sieger et al. |
| 5,394,727 | A | | 3/1995 | Diekhoff et al. |
| 5,622,070 | A | | 4/1997 | Bulso, Jr. |
| 5,857,374 | A | | 1/1999 | Stodd |
| 5,881,593 | A | | 3/1999 | Bulso, Jr. et al. |
| 6,386,013 | B1 | | 5/2002 | Werth |
| 6,505,492 | B2 | | 1/2003 | Jroski |
| 7,124,613 | B1 | | 10/2006 | McClung |
| 2009/0026214 | A1 | | 1/2009 | Yuan et al. |
| 2012/0067102 | A1 | | 3/2012 | Stodd |
| 2012/0279272 | A1 | | 11/2012 | Zhou et al. |
| 2015/0251237 | A1 | | 9/2015 | Carstens et al. |

FOREIGN PATENT DOCUMENTS

| | | |
|---|---|---|
| JP | 62-230439 | 10/1987 |
| JP | 07-144239 | 6/1995 |
| JP | 07-232230 | 9/1995 |
| JP | 2004-314084 | 11/2004 |
| JP | 20080154992.3 | 9/2009 |
| JP | 2012-535231 | 8/2014 |
| WO | 2001087515 | 11/2001 |
| WO | 2013173398 | 11/2013 |

OTHER PUBLICATIONS

European Patent Office "Supplementary European Search Report for PCT/US2013041041," dated Jan. 8, 2016, 6 pp.

Stolle Machinery Company, LLC, English Translation of CN Search Report 201080046932.X, dated Jan. 6, 2014, 9 pages.

Stolle Machinery Company, LLC, International Search Report, PCT/US2013/041041, Oct. 4, 2013, 9 pages.

* cited by examiner $$F_1 = F_2$$

$$P_1 \ A_1 = P_2 \ A_2$$

$$\frac{P_1}{P_2} = \frac{A_2}{A_1}$$

$A_1$ = PRESSURE SURFACE (560)

$A_2$ = FORMING SURFACE (600)

$$F_1 = F_2$$

$$P_1 \ A_1 = P_2 \ A_2$$

$$\frac{P_1}{P_2} = \frac{A_2}{A_1}$$

CONTAINER, AND SELECTIVELY FORMED SHELL, AND TOOLING AND ASSOCIATED METHOD FOR PROVIDING SAME

CROSS-REFERENCE TO RELATED APPLICATION

This application is continuation-in-part application of U.S. patent application Ser. No. 13/894,017, filed May 14, 2013, which application claims the benefit of U.S. Provisional Patent Application Ser. No. 61/648,698, filed May 18, 2012, entitled "CONTAINER, AND SELECTIVELY FORMED SHELL, AND TOOLING AND ASSOCIATED METHOD FOR PROVIDING SAME."

BACKGROUND

Field

The disclosed concept relates generally to containers and, more particularly, to can ends or shells for metal containers such as, for example, beer or beverage cans, as well as food cans. The disclosed concept also relates to methods and tooling for selectively forming a can end or shell to reduce the amount of material used therein.

Background Information

Metallic containers (e.g., cans) for holding products such as, for example, food and beverages, are typically provided with an easy open can end on which a pull tab is attached (e.g., without limitation, riveted) to a tear strip or severable panel. The severable panel is defined by a scoreline in the exterior surface (e.g., public side) of the can end. The pull tab is structured to be lifted and/or pulled to sever the scoreline and deflect and/or remove the severable panel, thereby creating an opening for dispensing the contents of the can.

When the can end is made, it originates as a can end shell, which is formed from a blank cut (e.g., blanked) from a sheet metal product (e.g., without limitation, sheet aluminum; sheet steel). The shell is then conveyed to a conversion press, which has a number of successive tool stations. As the shell advances from one tool station to the next, conversion operations such as, for example and without limitation, rivet forming, paneling, scoring, embossing, tab securing and tab staking, are performed until the shell is fully converted into the desired can end and is discharged from the press.

In the can making industry, large volumes of metal are required in order to manufacture a considerable number of cans. Thus, an ongoing objective in the industry is to reduce the amount of metal that is consumed. Efforts are constantly being made, therefore, to reduce the thickness or gauge (sometimes referred to as "down-gauging") of the stock material from which can ends and can bodies are made. However, as less material (e.g., thinner gauge) is used, problems arise that require the development of unique solutions. There is, therefore, a continuing desire in the industry to reduce the gauge and thereby reduce the amount of material used to form such containers. However, among other disadvantages associated with the formation of can ends from relatively thin gauge material, is the tendency of the can end to wrinkle, for example, during forming of the shell.

Prior proposals for reducing the volume of metal used reduce the blank size for the can end, but sacrifice the area of the end panel. This undesirably limits the available space, for example, for the scoreline, the severable panel and/or the pull tab.

There is, therefore, room for improvement in containers such as beer/beverage cans and food cans, as well as in selectively formed can ends or shells and tooling and methods for providing such can ends or shells.

SUMMARY

These needs and others are met by the disclosed concept, which is directed to a selectively formed shell, a container employing the selectively formed shell, and tooling and associated methods for making the shell. Among other benefits, the shell is selectively stretched and thinned to reduce the amount of metal required while maintaining the desired strength.

As one aspect of the disclosed concept, a shell is structured to be affixed to a container. The shell comprises: a center panel; a circumferential chuck wall; an annular countersink between the center panel and the circumferential chuck wall; and a curl extending radially outwardly from the chuck wall. The material of at least one predetermined portion of the shell is selectively stretched relative to at least one other portion of the shell, thereby providing a corresponding thinned portion.

The shell may be formed from a blank of material, wherein the blank of material has a base gauge prior to being formed, and wherein, after being formed, the material of the shell at or about the thinned portion has a thickness. The thickness of the material at or about the thinned portion is less than the base gauge. The thinned portion may include the chuck wall.

As another aspect of the disclosed concept, a method is provided for forming a shell. The method comprises: introducing material between tooling, forming the material to include a center panel, a circumferential chuck wall, an annular countersink between the center panel and the circumferential chuck wall, and a curl extending radially outwardly from the chuck wall, and selectively stretching at least one predetermined portion of the shell relative to at least one other portion of the shell to provide a corresponding thinned portion of the shell.

The method may comprise the step of converting the shell into a finished can end. The method may further comprise the step of seaming the finished can end onto a container body.

As a further aspect of the disclosed concept, tooling is provided for forming a shell. The tooling comprises: an upper tool assembly; and a lower tool assembly cooperating with the upper tool assembly to form material disposed therebetween to include a center panel, a circumferential chuck wall, an annular countersink between the center panel and the circumferential chuck wall, and a curl extending radially outwardly from the chuck wall. The upper tool assembly and the lower tool assembly cooperate to selectively stretch the material of at least one predetermined portion of the shell relative to at least one other portion of the shell, thereby providing a corresponding thinned portion.

Selectively thinning a predetermined portion of the shell relative to at least one other portion of the shell to provide a corresponding thinned portion of the shell has been determined to create certain complications such as an overloading condition on the tooling and/or press. Further, the selective thinning may result in excessively uneven thinning. That is, while some unevenness in the thinning is acceptable, excessive uneven thinning is not desirable. It is desirable that the selective thinning be accomplished with existing presses. There is, therefore, room for improvement in the tooling.

These needs and others are met by the disclosed concept, which is directed to a tooling including a force and/or pressure concentrating forming surface and/or a hybrid bias generating assembly. In an exemplary embodiment, the hybrid bias generating assembly is one of an active hybrid bias generating assembly or a selectable hybrid bias generating assembly, as defined below. It is understood that, in the known art, to increase the pressure acting on a shell, manufacturers simply increased the pressure acting on the tooling. This increase in pressure created a counter load that was applied to the press. As disclosed herein, concentrating the force/pressure on a forming surface allows for reduced counter loads to be applied to the press. An increase in the pressure surface area of the upper surface of the upper tool assembly and a reduction in the forming surface area that clamps the blanks solves the stated problem. In an exemplary embodiment, the concentrating forming surface allows for a ratio of the total bias pressure to the clamping pressure of between about 1:10 to 1:50, or between about 1:20 and 1:40, or about 1:30. That is, a total bias pressure is applied to a pressure surface and the resulting pressure at the clamping surface is between about 10 to 50, or between about 20 and 40, or about 30 times greater. Such ratios of total bias pressure to the clamping pressure allows for a reduction in the loading condition on the tooling and/or press and therefore solves the stated problem. Further, the use of a hybrid bias generating assembly prevents an excessive amount of uneven thinning and therefore solves the stated problem.

In an exemplary embodiment, an upper tool assembly piston includes a piston that is coupled to an upper pressure sleeve. The piston includes an upper side that is exposed to a pressure. The upper pressure sleeve includes a lower forming surface. The area ratio of the upper tool assembly piston upper side to the upper pressure sleeve lower forming surface is between about 10:1 to 50:1, 20:1 and 40:1, or about 30:1. A tool assembly with this area ratio solves the problems stated above. That is, as shown in FIGS. 12A and 12B, in the known art, the ratio of the area of the upper tool assembly piston upper side to the upper pressure sleeve lower forming surface is about 4:1. This ratio, compared to the disclosed concept, includes a smaller upper tool assembly piston upper side and a large upper pressure sleeve lower forming surface. It is noted that, in this configuration, the metal is not thinned, as discussed above. As shown in FIGS. 13A and 13B, and in an exemplary embodiment, the ratio of the area of the upper tool assembly piston upper side to the upper pressure sleeve lower forming surface is about 30:1. An upper tool assembly having the configuration of the disclosed concept is a force concentrating, and/or pressure concentrating, forming surface that solves the stated problems.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
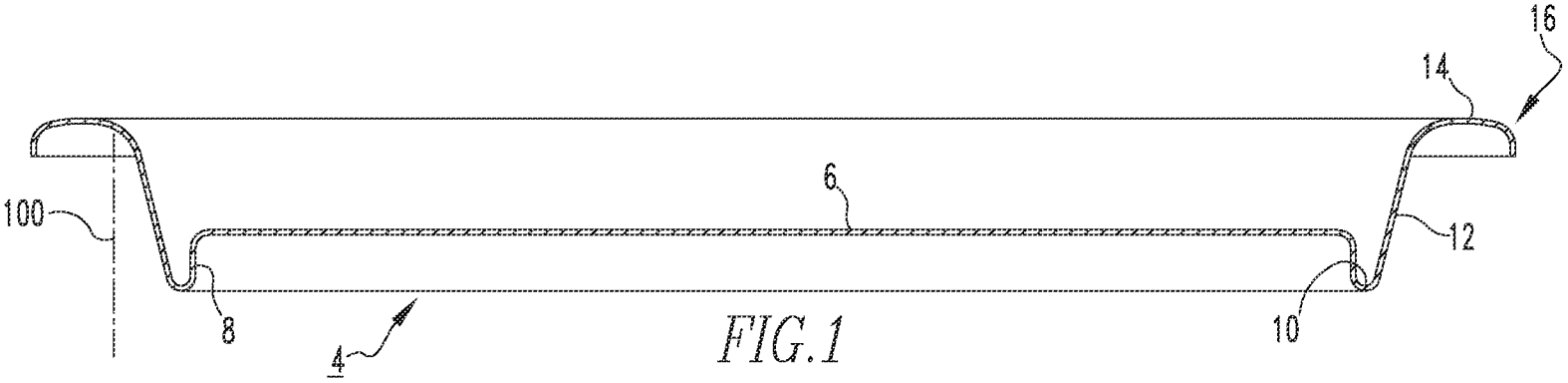
FIG. 1 is a side elevation section view of a shell for a beverage can end, also showing a portion of a beverage can in simplified form in phantom line drawing.

For purposes of illustration, embodiments of the disclosed concept will be described as applied to shells for a can end known in the industry as a "B64" end, although it will become apparent that they could also be employed to suitably selectively stretch and thin predetermined portions or areas of any known or suitable alternative type (e.g., without limitation, beverage/beer can ends; food can ends) and/or configuration other than B64 ends.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled"

means that two elements are directly in contact with each other. It is noted that moving parts, such as but not limited to circuit breaker contacts, are "directly coupled" when in one position, e.g., the closed, second position, but are not "directly coupled" when in the open, first position. As used herein. "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, and in the phrase "[x] moves between a first position and a second position corresponding to [y] first and second positions," wherein "[x]" and "[y]" are elements or assemblies, the word "correspond" means that when element [x] is in the first position, element [y] is in the first position, and, when element [x] is in the second position, element [y] is in the second position. It is noted that "correspond" relates to the final positions and does not mean the elements must move at the same rate or simultaneously. That is, for example, a hubcap and the wheel to which it is attached rotate in a corresponding manner. Conversely, a spring biased latched member and a latch release move at different rates. Thus, as stated above. "corresponding" positions mean that the elements are in the identified first positions at the same time, and, in the identified second positions at the same time.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate.

As used herein, the word "unitary" means a component that is created as a single piece or unit. That is, a component that includes pieces that are created separately and then coupled together as a unit is not a "unitary" component or body.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]." As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e. the named element or assembly that precedes the pronoun "its."

As employed herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and soda cans, as well as food cans.

As employed herein, the term "can end" refers to the lid or closure that is structured to be coupled to a can, in order to seal the can.

As employed herein, the term "can end shell" is used substantially interchangeably with the term "can end." The "can end shell" or simply the "shell" is the member that is acted upon and is converted by the disclosed tooling to provide the desired can end.

As employed herein, the terms "tooling," "tooling assembly" and "tool assembly" are used substantially interchangeably to refer to any known or suitable tool(s) or component(s) used to form (e.g., without limitation, stretch) shells in accordance with the disclosed concept.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the term "number" shall mean one or an integer greater than one (i.e., a plurality).

Figure 2:
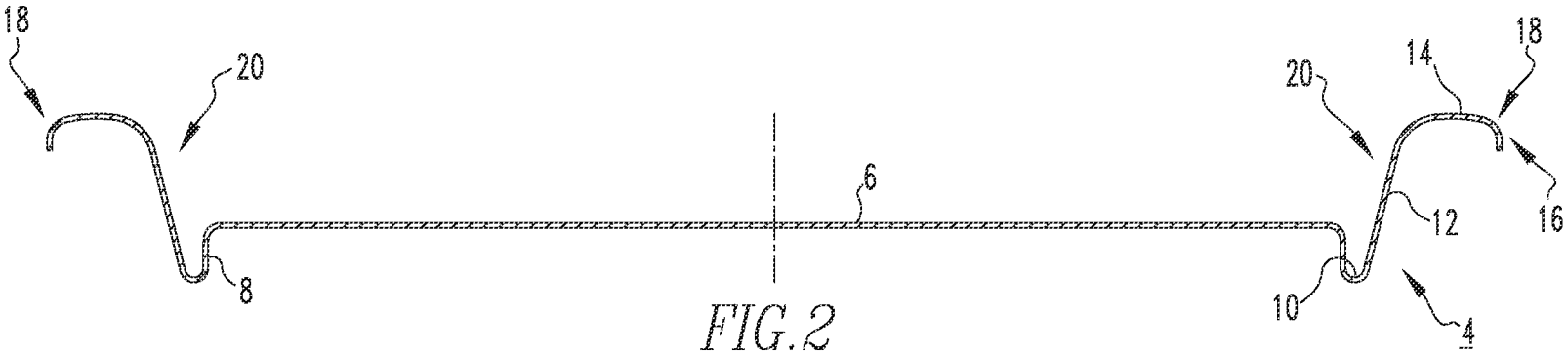
FIG. 2 is a side elevation section view of the shell of FIG. 1, showing various thinning locations, in accordance with one non-limiting aspect of the disclosed concept.

FIGS. 1 and 2 show a can end shell 4 that is selectively formed in accordance with one non-limiting example embodiment of the disclosed concept. Specifically, as described in detail herein below, the material in certain predetermined areas of the shell 4, has been stretched, thereby thinning it, whereas other areas of the shell 4 preferably maintain the base metal thickness. Although the example shown and described herein refers to a shell (see, for example and without limitation, shell 4 of FIGS. 1-3, 5 and 6E) for a beverage can body 100 (partially shown in simplified form in phantom line drawing in FIG. 1), it will be appreciated that the disclosed concept could be employed to stretch and thin any known or suitable can end shell type and/or configuration for any known or suitable alternative type of container (e.g., without limitation, food can (not shown)), which is subsequently further formed (e.g., converted) into a finished can end for such a container.

The shell 4 in the non-limiting example shown and described herein includes a circular center panel 6, which is connected by a substantially cylindrical panel wall 8 to an annular countersink 10. The example annular countersink 10 has a generally U-shaped cross-sectional profile. A tapered chuck wall 12 connects the countersink 10 to a crown 14, and a peripheral curl or outer lip 16 extends radially outwardly from the crown 14, as shown in FIGS. 1, 2 and 6E.

In the non-limiting example of FIG. 2, the shell 4 has a base metal thickness of about 0.0082 inch. This base metal thickness is preferably substantially maintained in areas such as the center panel 6 and outer lip or curl 16. Keeping the center panel 6 in the base metal thickness helps with rivet, score and tab functions in the converted end (not explicitly shown). For example and without limitation, undesirable issues such as wrinkling and/or undesired score-line and/or rivet or tab failures that can be attributed to reduced strength associated with thinned metal, are substantially eliminated by substantially maintaining the base thickness in the panel 6. Similarly, substantially maintaining the outer lip 16 at base gauge helps with the seaming ability, for seaming the lid or can end 4 to the can body 100 (partially shown in simplified form in phantom line drawing in FIG. 1). This area where preferably minimal to no thinning occurs, is indicated generally in FIG. 2 by reference 18.

Accordingly, the majority of the thinning (e.g., without limitation, between 5-20%, or about 10%, thinning) preferably occurs in the chuck wall 12. More specifically, thinning preferably occurs in the area between the crown 14 and the countersink 10, which is generally indicated as area 20 in FIG. 2. Thus, by way of illustration, in the non-limiting example of FIG. 2, the thickness of the material in the chuck wall 12 may be reduced to about 0.0074 inch. It will be appreciated that this is a substantial reduction, which results in significant weight reduction and cost savings over conventional can ends.

It will further be appreciated that the particular shell type and/or configuration and/or dimensions shown in FIG. 2 (and all of the figures provided herein) are provided solely for purposes of illustration and are not limiting on the scope of the disclosed concept. That is, any known or suitable alternative thinning of the base gauge could be implemented in additional and/or alternative areas of the shell (e.g., without limitation, 4) for any known or suitable shell, or end type and/or configuration, without departing from the scope of the disclosed concept.

Moreover, the disclosed concept achieves material thinning and an associated reduction in the overall amount and weight of material, without incurring increased material processing charges associated with the stock material that is supplied to form the end product. For example and without limitation, increased processing (e.g., rolling) of the stock material to reduce the base gauge (i.e., thickness) of the material can undesirably result in a relatively substantial increase in initial cost of the material. The disclosed concept achieves desired thinning and reduction, yet uses stock material having a more conventional and, therefore, less expensive base gauge.

Figure 3:
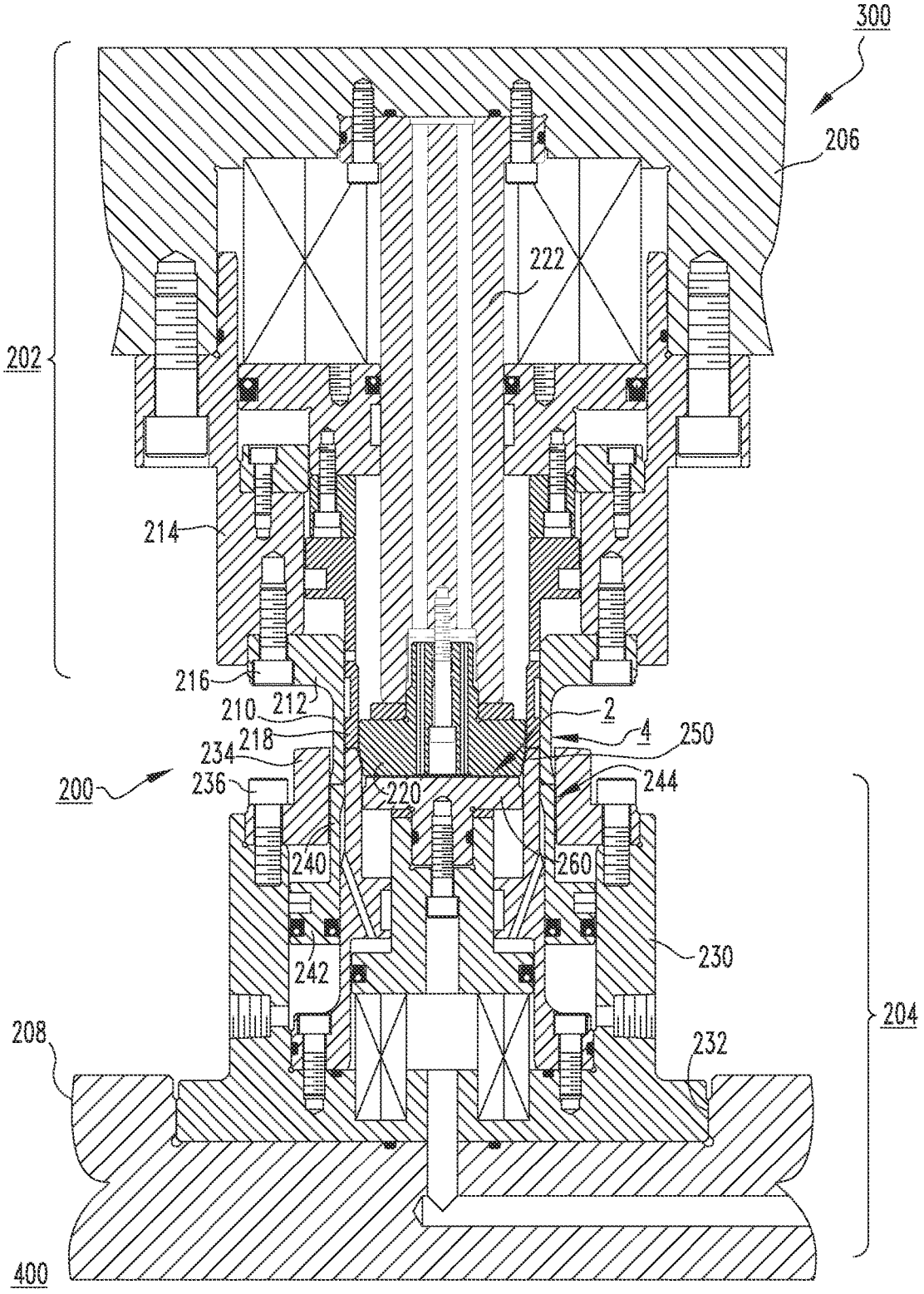
FIG. 3 is a side elevation section view of tooling in accordance with an embodiment of the disclosed concept.
Figure 4:
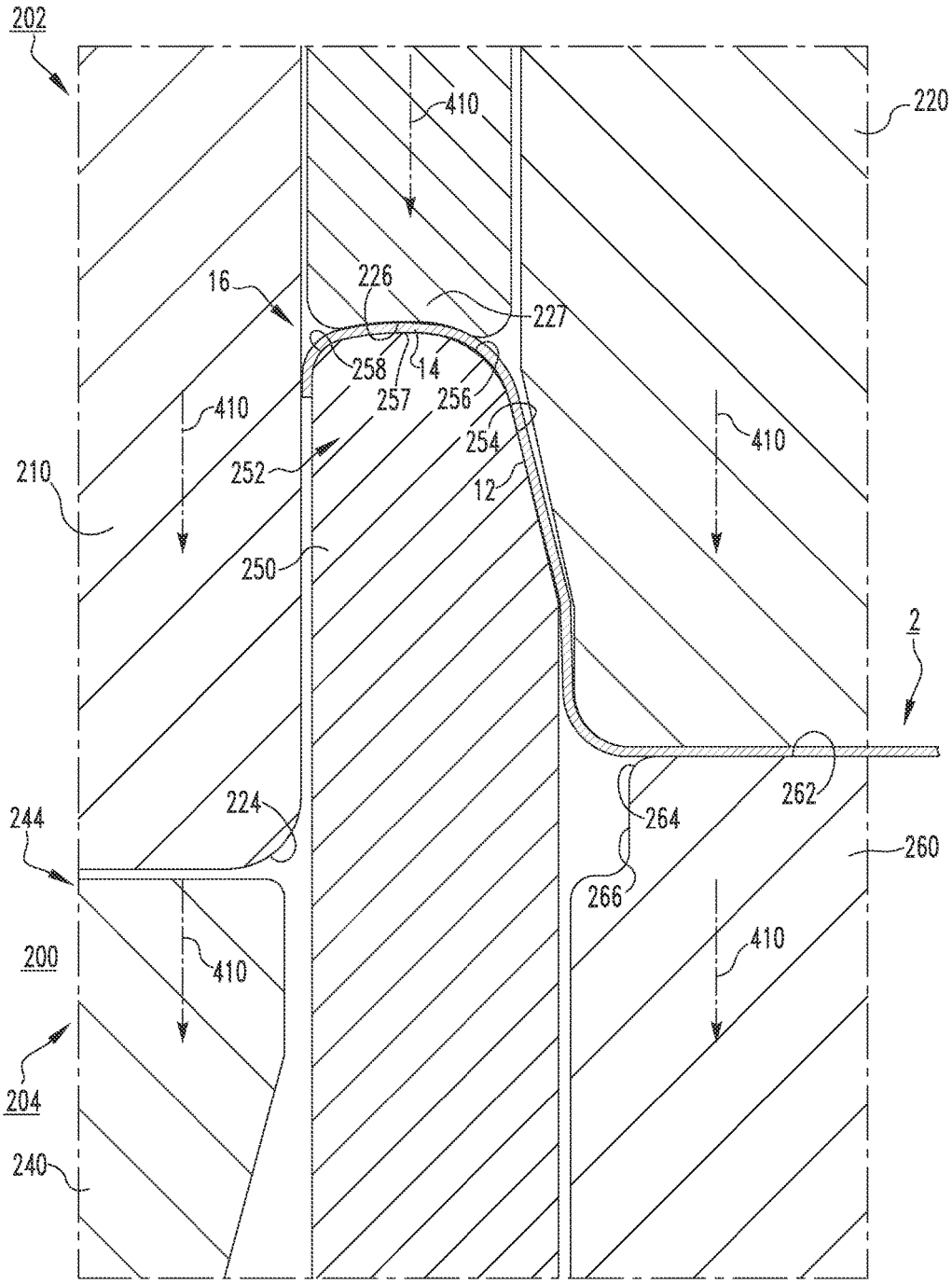
FIG. 4 is a side elevation section view of a portion of the tooling of FIG. 3.
Figure 5:
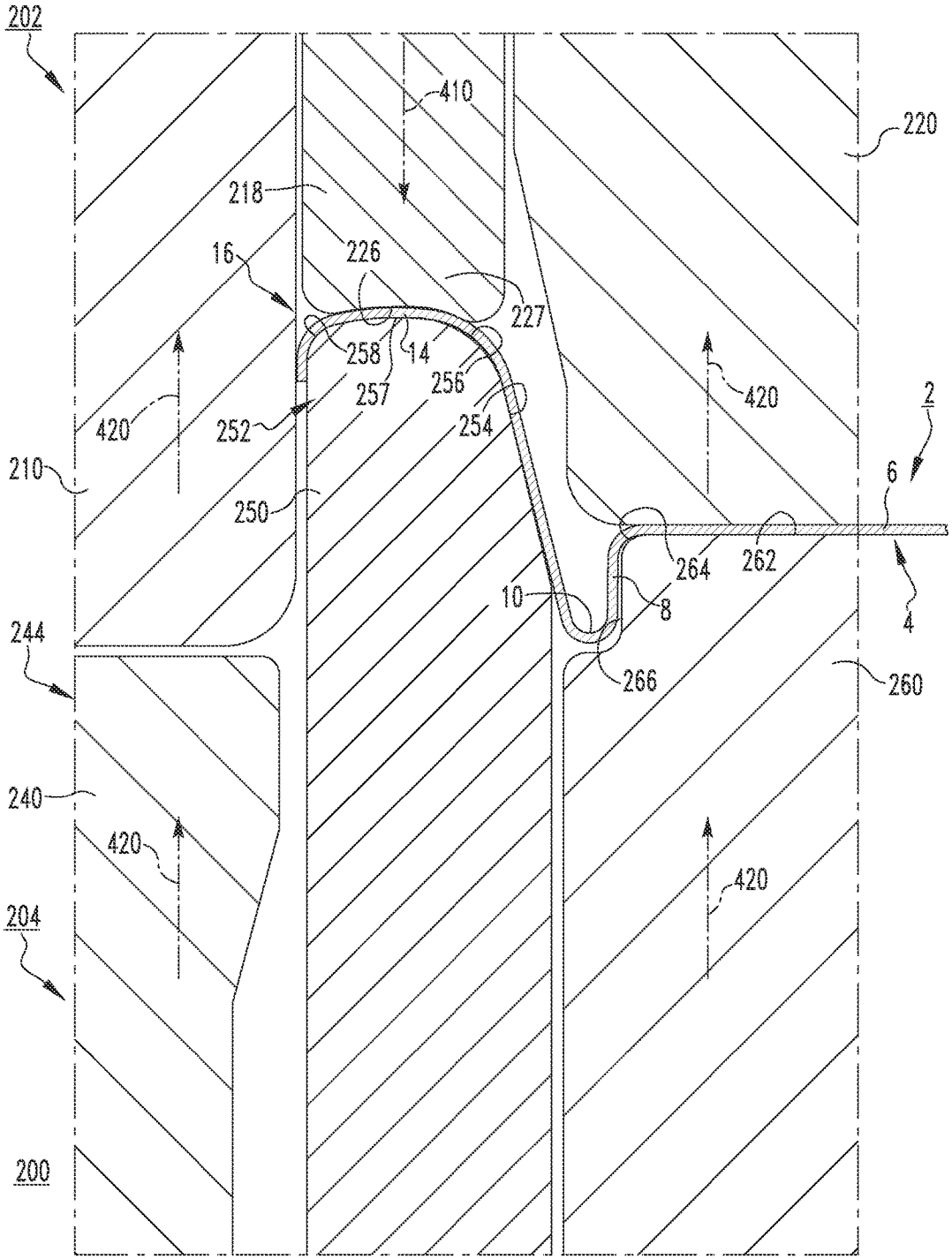
FIG. 5 is a side elevation section view of the portion of the tooling of FIG. 4, modified to show the tooling in a different position, in accordance with a non-limiting example forming method of the disclosed concept.

FIGS. 3-5 show various tooling assemblies 200 (or "tooling 200") for stretching and thinning the shell material, in accordance with one non-limiting example embodiment of the disclosed concept. Specifically, the selective forming (e.g., stretching and thinning) is accomplished by way of precise tooling geometry, placement and interaction. In accordance with one non-limiting embodiment, the process begins by introducing a blank of material (see, for example and without limitation, blank 2 of FIG. 6A) having a base metal thickness or gauge, between components of a tooling assembly 200.

FIG. 3 illustrates a single station 300, also known as a "pocket" 300, of a multiple station tooling assembly 200 coupled to a press 400. For example and without limitation, typically one shell 4 is produced at each station 300 during each stroke of a conventional high-speed single-action or double-action mechanical press 400 to which the multiple station tooling assembly 200 of the disclosed concept is coupled. The tooling assembly 200 includes opposing upper and lower tool assemblies 202, 204 that cooperate to form (e.g., without limitation, stretch; thin; bend) metal (see, for example and without limitation, metal blank 2 of FIG. 6A) to achieve the desired shell (see, for example, and without limitation, shell 4 of FIGS. 1-3, 5 and 6E), in accordance with the disclosed concept.

More specifically, the upper and lower tool assemblies 202, 204 are coupled to upper and lower die shoes 206, 208, which are respectively supported by the press bed and/or bolster plates and the ram within the press 400 in a generally well known manner. An annular blank and draw die 210 includes an upper flange portion 212, which is coupled to a retainer or riser body 214 by a number of fasteners 216. The blank and draw die 210 surrounds an upper pressure sleeve 218. That is, the blank and draw die 210 is proximate to the upper pressure sleeve 218 and is located radially outward from the upper pressure sleeve 218. An inner die member or die center 220 is supported within the upper pressure sleeve 218 by a die center riser 222. The blank and draw die 210 includes an inner curved forming surface 224 (FIGS. 4 and 5). The lower end 227 of the upper pressure sleeve 218 includes a contoured annular forming surface 226 (FIGS. 4 and 5).

Continuing to refer to FIG. 3, an annular die retainer 230 is coupled to the lower die shoe 208 within a counterbore 232. An annular cut edge die 234 is coupled to the die retainer 230 by suitable fasteners 236. An annular lower pressure sleeve 240 includes a lower piston portion 242 for movement within the die retainer 230. The lower pressure sleeve 240 further includes an upper end 244 having a substantially flat surface which opposes the lower end of the aforementioned blank and draw die 210. The cut edge die 234 is located proximate to the lower pressure sleeve 240 and radially outward from the upper end 244 of the lower pressure sleeve 240, as shown. A die core ring 250 is disposed within the lower pressure sleeve 240, and includes an upper end 252 that opposes the lower end or forming surface 226 of the upper pressure sleeve 218, as best shown in FIGS. 4 and 5. The upper end 252 includes a tapered surface 254, a rounded, or curvilinear, inner surface 256 and a rounded outer surface 258 (all shown in FIGS. 4 and 5). A circular panel punch 260 is disposed within the die core ring 250 opposite the aforementioned die center 220. The panel punch 260 includes a circular, substantially flat upper surface 262 having a peripheral rounded surface 264. A peripheral recessed portion 266 extends downwardly from the rounded surface 264, as best shown in FIGS. 4 and 5.

Accordingly, the foregoing tools of the upper tool assembly 202 and lower tool assembly 204 cooperate to form and, in particular, stretch and thin predetermined selected areas of, the shell 4, as will now be described in greater detail with respect to FIGS. 6A-6E, which illustrate the method and associated forming stages for forming the stretched and thinned shell 4, in accordance with one non-limiting embodiment of the disclosed concept.

Figure 6A:
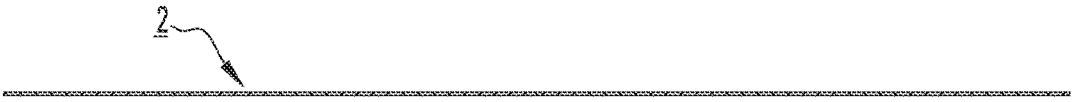
FIGS. 6A-6E are side elevation views of consecutive forming stages for forming a shell, in accordance with a non-limiting example embodiment of the disclosed concept.
Figure 6B:
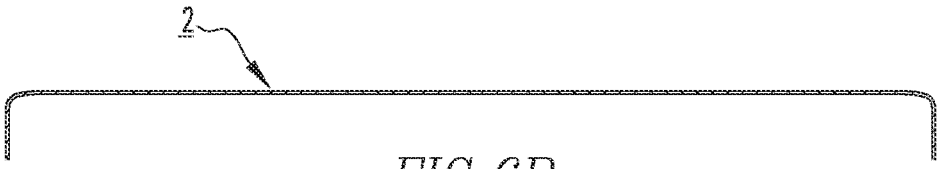
Figure 6C:
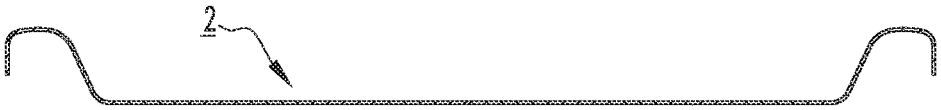

FIG. 6A shows a first forming step wherein a blank 2 is provided using the aforementioned tooling assembly 200 (FIGS. 3-5). More specifically, respective cut edges of the blank and draw die 210 and annular cut edge die 234 cooperate to cut (e.g., blank) the blank 2, for example, from a web or sheet of material. In a second step, shown in FIG. 6B, the tooling 200 cooperates to make a first bend, namely bending the peripheral edges of the blank 2 downward, as shown. Next, in the forming step shown in FIG. 6C, the outer portions of the blank 2 are further formed, as shown. This is achieved by the inner curved surface 224 of the blank and draw die 210 cooperating with the upper end 252 of the die core ring 250, and by the forming surface 226 of the upper pressure sleeve 218 cooperating with the upper end 252 of the die core ring 250.

Figure 6D:
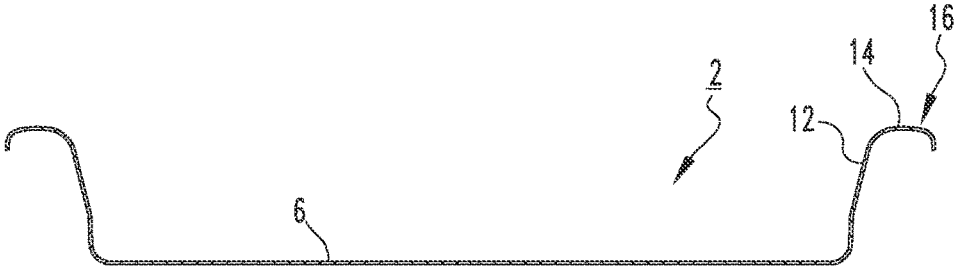
Figure 6E:
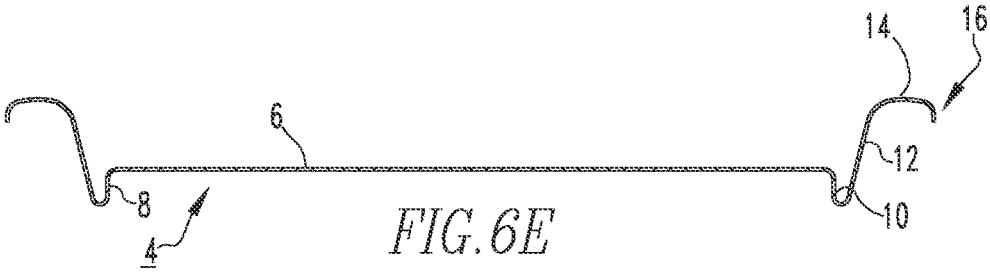

Stretching and thinning in accordance with the aforementioned non-limiting embodiment of the disclosed concept will be further described and understood with reference to the fourth forming step, illustrated in FIGS. 4 and 6D. Specifically, FIG. 4 shows the tooling assembly 200 after a down stroke, wherein all of the tools shown have moved downward in the direction of arrows 410 to the positions shown. That is, the blank and draw die 210 and lower pressure sleeve 240 have moved downward in the direction of arrows 410 to further form the outer lip or curl 16. The upper pressure sleeve 218 has also moved downward in the direction of arrow 410, such that the forming surface 226 of the upper pressure sleeve 218 cooperates with the upper end 252 of the die core ring 250 to further form the crown 14, as shown. The die center 220, which also moves downward in the direction of arrow 410, stretches the metal of the blank 2 in the area of the chuck wall 12 as the substantially flat surface of the lower end of the die center 220 clamps the material between the die center 220 and the substantially flat upper surface 262 of the panel punch 260. The die center 220 and panel punch 260 both move downward in the direction of arrows 410 to stretch and thin the metal in the area of the chuck wall 12 as it cooperates with the tapered surface 254 of the die core ring 250. Thus, in the fourth forming step, the material of the blank 2 is stretched and thinned in the area that will become the chuck wall 12, but little to no stretching or thinning occurs in the outer lip or curl area 16, or in the area that will be later formed into the panel 6 (FIGS. 5 and 6E) or in the lower area that will be later formed into the annular countersink 10 (FIGS. 5 and 6E). These areas remain substantially at base gauge metal thickness, as previously discussed hereinabove.

In the fifth and final shell forming step, formation of the shell 4 is completed. Specifically, as shown in FIG. 5, which illustrates the same tooling assembly 200 shown and described hereinabove with respect to the downward stroke of FIG. 4, some of the tooling assembly 200 has moved upward in FIG. 5 in the direction of arrows 420 to form the panel 6 of the shell 4. Specifically, the blank and draw die 210, die center 220, lower pressure sleeve 240, and panel punch 260 all move upward in the direction of arrow 420, whereas the upper pressure sleeve 218 has stopped moving downward in the direction of arrow 410 at this point and is holding pressure on the shell 4. This results in the further formation of the outer lip or curl 16 over the rounded outer surface 258 of the die core ring 250, as well as the further formation of the crown 14 between the forming surface 226 of the upper pressure sleeve 218 and the upper end 252 of the die core ring 250. The desired final form of the chuck wall 12 is provided by interaction of the upper pressure sleeve 218 and surfaces 254 and 256 of the die core ring 250. The panel 6 is formed by interaction of the substantially flat upper surface 262 of the panel punch 260 with the die center 220 as both of these components move upward in the direction of arrows 420 with the metal of the blank 2 that becomes the panel 6 disposed (e.g., clamped) therebetween. This movement also facilitates the formation of the cylindrical panel wall 8 and countersink 10. Specifically, as the panel punch 260 moves upward and the upper pressure sleeve 218 moves downward, the annular countersink 10 is formed within the peripheral recessed portion 266 of the panel punch 260. The cylindrical panel wall 8 is, therefore, formed as the metal cooperates with the peripheral rounded surface 264 of the panel punch 260.

Accordingly, it will be appreciated that the disclosed concept differs substantially from conventional shell forming methods and tooling, wherein the material of the blank 2 or shell 4 is not specifically stretched or thinned. That is, while the panel 6, countersink 10 and outer lip or curl 16 portions of the example shell 4 (FIGS. 1-3, 5 and 6E) are not stretched or are nominally stretched, the area 20 (FIG. 2) between the countersink 10 and crown 14 is stretched and thinned during the forming process and, in particular in the fourth forming step shown in FIGS. 5 and 6D.

It will be appreciated that while five forming stages are shown in FIGS. 6A-6E, that any known or suitable alternative number and/or order of forming stages could be performed to suitably selectively stretch and thin material in accordance with the disclosed concept. It will further be appreciated that any known or suitable mechanism for sufficiently securing certain areas of the material to resist movement (e.g., sliding) or flow or thinning of the material while other predetermined areas of the material are stretched and thinned could be employed, without departing from the scope of the disclosed concept. Moreover, alternative, or additional, areas of the shell 4 (e.g., without limitation, 4) other than those which are shown and described herein could be suitably stretched and thinned, and the disclosed concept could be applied to stretch shells that are of a different type and/or configuration altogether (not shown).

Accordingly, it will be appreciated that the disclosed concept provides tooling assembly 200 (FIGS. 3-5) and methods for selectively stretching and thinning predetermined areas (see, for example and without limitation, area 20 of FIG. 2) of a shell 4 (FIGS. 1-3, 5 and 6E), thereby providing relatively substantially material and cost savings.

Figure 7:
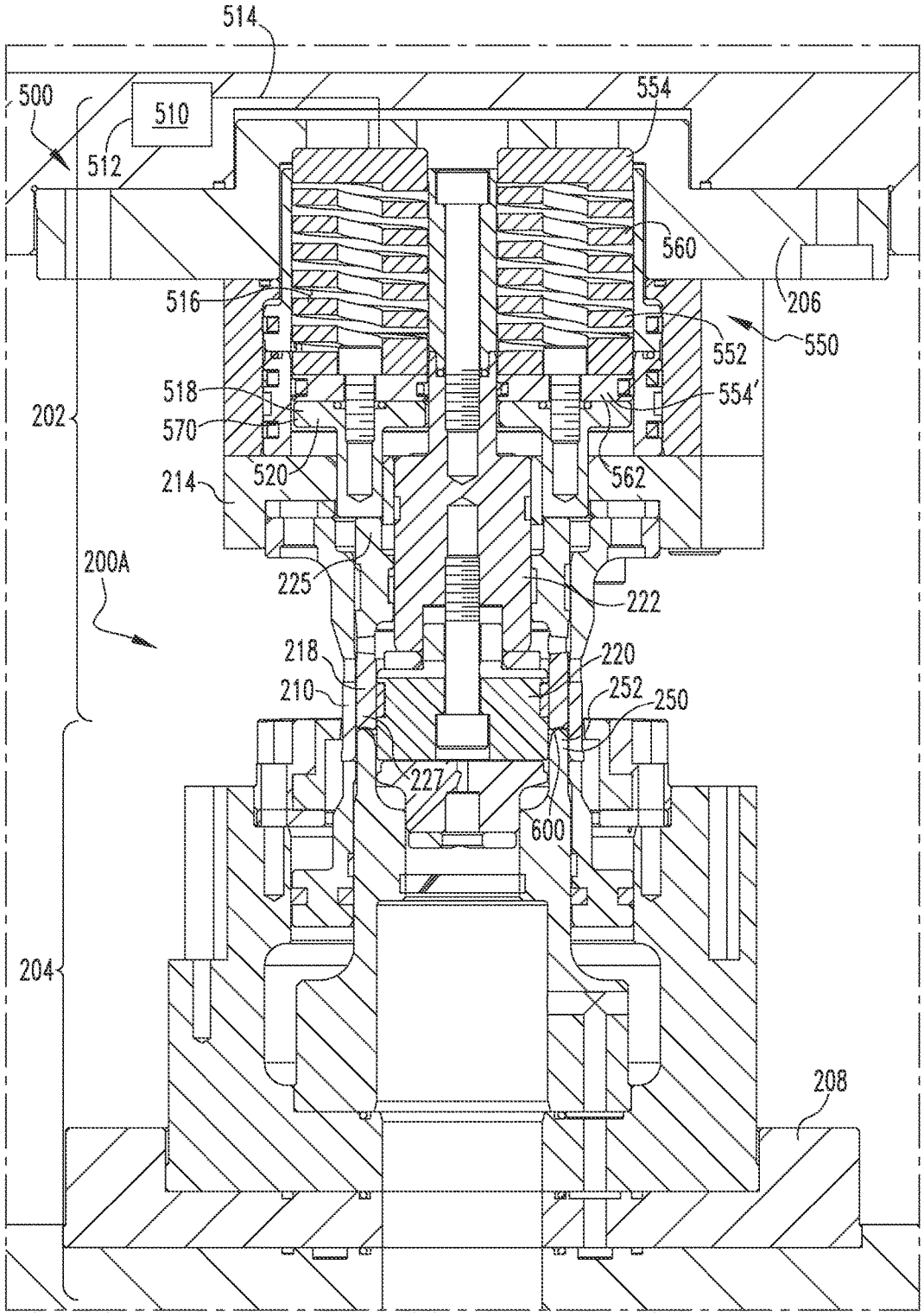
FIG. 7 is a side elevation section view of tooling in accordance with an alternate embodiment of the disclosed concept.
Figure 8:
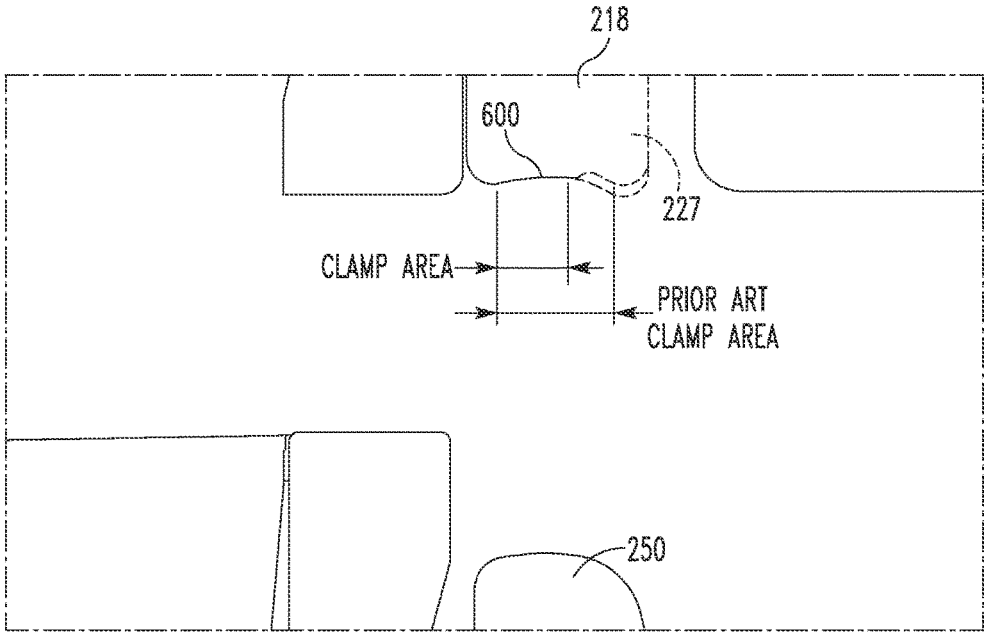
FIG. 8 is a detail side elevation section view of pressure concentrating forming surface showing a prior art forming surface in ghost.

Another embodiment of the disclosed invention is shown in FIG. 7. Other than the elements discussed below, the tooling 200A is substantially similar to the tooling assembly 200 discussed above and like elements will use like reference numbers. As discussed above, and in an exemplary embodiment, the die core ring upper end 252 opposes the lower end or forming surface 226 of the upper pressure sleeve 218. As further described above, the outer portions of the blank 2 are formed by the forming surface 226 of the upper pressure sleeve 218 cooperating with the upper end 252 of the die core ring 250. That is, both the die core ring upper end 252 and the upper pressure sleeve forming surface 226 engage the blank 2. As used herein, simultaneous engagement by elements disposed in opposition to each other is identified as "clamping."

As noted above, the die core ring upper end 252 includes a tapered surface 254, a rounded inner surface 256 and a rounded outer surface 258. In an exemplary embodiment, the die core ring upper end 252 further includes a generally horizontal surface 257. As used herein, the "generally horizontal surface" 257 is that portion of the die core ring upper end that extends in a plane that is generally perpendicular to the axis of motion of the upper and lower tool assemblies 202, 204. As used herein, "generally perpendicular" means perpendicular+/−about 10 degrees.

In this exemplary embodiment, the upper tool assembly 202 and the lower tool 204 assembly move between a separated, first position, wherein the upper tool assembly 202 is spaced from the lower tool assembly 204, and a forming position, wherein the upper tool assembly 202 is immediately adjacent the lower tool assembly 204 to selectively stretch the material of at least one predetermined portion of the shell 4 relative to at least one other portion of the shell, thereby providing a corresponding thinned portion. When the upper tool assembly 202 and the lower tool 204 are in the forming position, the upper pressure sleeve 218 and the die core ring 250 clamp the shell 4, as described above. The force acting on the blank 2 is, as used herein, the "clamping force."

In this exemplary embodiment, the upper tool assembly 202 also includes a hybrid bias generating assembly 500 and the upper pressure sleeve forming surface 226 is a force concentrating forming surface 600. As used herein, a "hybrid bias generating assembly" is an assembly that generates a bias in at least two different manners, and, the bias is applied to the same component. That is, as used herein, a "hybrid bias generating assembly" includes at least two bias generating assemblies that apply bias to the same component as well as a number of hybrid components. Thus, an assembly, such as, but not limited to the hybrid bias generating assembly 500 described herein, which generates a bias via a compressed fluid (pressure bias) and via a spring (mechanical bias) satisfies the first requirement of being an active hybrid bias generating assembly. Conversely, a device with a high pressure compressor and a low pressure compressor (both producing pressure bias) is not a "hybrid bias generating assembly" because the manner of producing bias is the same. Further, an assembly wherein one type of bias is applied to one component and another type of bias is applied to a different component is also not an "hybrid bias generating assembly" because the bias is not applied to the same component.

Further, as used herein, an "active hybrid bias generating assembly" is an assembly that includes at least two bias generating assemblies that apply bias to the same component at the same time. Further, as used herein, a "selectable hybrid bias generating assembly" is an assembly that includes at least two bias generating assemblies, and, the bias is selectively applied to the same component. That is, in a "selectable hybrid bias generating assembly" has the capability of applying bias in at least two different manners and the user determines which bias generating assembly, or both, apply bias to a component. Thus, when a user selects two manners of applying bias, the "selectable hybrid bias generating assembly" operates as an "active hybrid bias generating assembly." Stated alternately, an "active hybrid bias generating assembly" is a type of "selectable hybrid bias generating assembly" but the opposite is not always true. That is, not all "selectable hybrid bias generating assemblies" are "active hybrid bias generating assemblies." A "selectable hybrid bias generating assembly" that applies bias in only one of several available manners is a "selectable hybrid bias generating assembly" but not an "active hybrid bias generating assembly." In an exemplary embodiment, the hybrid bias generating assembly 500 is one of an active hybrid bias generating assembly 502 or a selectable hybrid bias generating assembly 504.

The hybrid bias generating assembly 500 includes a pressure generating assembly 510, a mechanical bias assembly 550, and a number of hybrid components 570. As used herein, "hybrid components" 570 are components that are structured to be utilized by both bias generating assemblies, in the exemplary embodiment, the pressure generating assembly 510 and the mechanical bias assembly 550. The pressure generating assembly 510 includes a pressure generating device 512 (shown schematically), a pressure communication assembly 514 (shown schematically), a pressure chamber 516, and a piston assembly 518. The pressure generating device 512 is any known device structured to compress a fluid, or store compressed fluid, at an increased pressure, such as, but not limited to a fluid pump or compressor. The pressure communication assembly 514 includes any number of hoses, conduits, passages or any other construct capable of communicating a pressurized fluid. It is understood the pressure communication assembly 514 also includes seals, valves or any other construct required to control the communication of a pressurized fluid.

In an exemplary embodiment, the riser body 214 is sealingly coupled, directly coupled, or fixed to the upper die shoe 206. In this configuration, the riser body 214 defines the pressure chamber 516. It is understood that the pressure chamber 516 includes a number of seals, not identified, required to prevent fluid from escaping. The piston assembly 518 includes a torus-shaped body 520 and, in an exemplary embodiment, a spring seat 554, as discussed below. In another embodiment, not shown, the piston body and the spring seat are a unitary body. It is understood that the description of the piston body 520 applicable to the spring seat 554 is an embodiment that includes a spring seat 554. For example, the piston body 520 corresponds to the pressure chamber 516 and the die center riser 222; it is understood that in an embodiment with a spring seat 554 the spring seat 554 corresponds to the pressure chamber 516 and the die center riser 222. Thus, the outer radial surface of the piston body 520, or the spring seat 554, is sealingly coupled to the inner surface of the pressure chamber 516, and, the inner radial surface of the piston body 520 is sealingly coupled to the outer surface of the die center riser 222. It is understood that the piston assembly 518 includes a number of seals, not identified, required to prevent fluid from escaping the pressure chamber 516. The piston assembly 518 is movably disposed in the pressure chamber 516.

The pressure generating device 512 is in fluid communication, via the pressure communication assembly 514, with the pressure chamber 516. The fluid, and therefore the pressure associated therewith, is communicated to the upper side of the piston body 520, hereinafter the "pressure surface" 521. It is understood that, in an embodiment with a spring seat 554, the pressure surface 521 may be the upper surface of the spring seat 554. In an exemplary embodiment, the total bias force is applied to the pressure surface 521 which has an area of between about 3.46 $in^2$ to 17.3 $in^2$, or about 10.38 $in^2$. Thus, the pressure generating device 512 is structured to control the position of the piston assembly 518 in the pressure chamber 516, and is structured to move the piston assembly 518 in the pressure chamber 516. The piston assembly 518 is coupled to the upper pressure sleeve 218. That is, the upper pressure sleeve 218 includes an upper end 225 opposite the forming surface 226. The piston assembly 518 is coupled to the upper pressure sleeve upper end 225. Thus, as the piston assembly 518 moves within the pressure chamber 516, the upper pressure sleeve 218 moves between an extended, first position, wherein the upper pressure sleeve lower end 227 is more spaced from the upper die shoe 206, and a retracted, second position, wherein the upper pressure sleeve lower end 227 is less spaced from the upper die shoe 206.

In this configuration, the piston assembly 518 and the piston body 520 are "hybrid components" 570 as defined herein. That is, the piston assembly 518 and the piston body 520 are structured to be utilized by both the pressure generating assembly 510 and the mechanical bias assembly 550. It is noted that a piston associated exclusively with a pressure generating assembly 510 or exclusively with a mechanical bias assembly 550 cannot be a "hybrid component" as defined herein. That is, by definition, a piston assembly 518 associated exclusively with a pressure generating assembly 510 cannot be "structured to" be utilized by both bias generating assemblies. Similarly, by definition, a piston assembly 518 associated exclusively with a mechanical bias assembly 550 cannot be "structured to" be utilized by both bias generating assemblies. Accordingly, a piston associated exclusively with a pressure generating assembly 510 or exclusively with a mechanical bias assembly 550 is not a "hybrid component" as used herein.

In an exemplary embodiment, the mechanical bias assembly 550 includes a number of spring assemblies 552 and a number of spring seats 554. A spring assembly 552 includes a number of springs 560 associated with each spring seat 554. In one embodiment, each spring assembly 552 includes a single, linear spring rate compression spring 560. In this embodiment, the mechanical bias assembly 550 is structured to, and does, apply a bias at a generally linear rate during the compression of the spring assemblies 552.

In another exemplary embodiment, each spring assembly 552 includes a number of springs 560 that have a variable spring rate. (It is understood that reference number 560 represents a "spring" rather than a specific type of spring.) The variable spring rate may be any of a progressive spring rate, a degressive spring rate, or a dual rate (sometime identified as "progressive with knee") spring rate. As used herein, a "progressive spring rate" is a spring rate that increases in compression in a non-linear manner. As used herein, a "degressive spring rate" is a spring rate that decreases in compression in a non-linear manner. As used herein, a "dual rate" spring rate is a spring rate that increases at a first linear, or generally linear, spring rate until a selected compression is achieved and thereafter the spring rate increases at a different second linear, or generally linear, spring rate. That is, the first and second spring rates are substantially different from each other. Variable rate springs include, but are not limited to, cylindrical springs with a variable pitch rate, conical springs, and mini block springs.

In one exemplary embodiment, all spring assemblies 552 include substantially the same type of spring 560, that is, for example, each spring assembly 552 includes a number of substantially similar linear spring rate compression springs 560, or, a number of substantially similar dual rate compression springs 560. In another exemplary embodiment, the spring assemblies 552 include different types of springs. For example, within the mechanical bias assembly 550, one set of spring assemblies 552 include a number of substantially similar linear spring rate compression springs 560, and, a second set includes a number of substantially similar dual rate compression springs 560. In another exemplary embodiment, the variable rate spring assemblies 552 may include any of a number of dual rate springs, a plurality of springs with different compression rates, a number of progressive springs, a number of degressive springs, or a combination of any of these.

In an exemplary embodiment, compression springs 560 are disposed in the pressure chamber 516. In this embodiment, at least a lower spring seat 554' is a torus-shaped body 562 that corresponds to the pressure chamber 516 and the die center riser 222. The lower spring seat 554' is coupled, directly coupled, fixed, or unitary with, the upper side of the piston body 520. The compression springs 560 are sized to be in compression when disposed in the pressure chamber 516. In this configuration, the mechanical bias assembly 550 biases, i.e. operatively engages, the piston assembly 518 and therefore the upper pressure sleeve 218. That is, the upper pressure sleeve 218 is biased to its first position.

In one exemplary embodiment, wherein the pressure concentrating forming surface 600, described below, has an area of about 0.346 $in^2$, the total bias pressure is a force of between about 7,000 lbfs and 9,000 lbfs, or about 8,000 lbfs acting on the pressure surface 521, which has an area of between about 3.46 $in^2$ to 17.3 $in^2$, between about 6.92 $in^2$ to 13.84 $in^2$, or about 10.38 $in^2$. Alternatively, in an embodiment wherein the pressure surface 521 has an area of about 10.38 $in^2$, the pressure concentrating forming surface 600, described below, has an area of between about 1.038 $in^2$ to 0.208 $in^2$, between about 0.519 $in^2$ to 0.2595 $in^2$, or about 0.346 $in^2$. That is, the force/pressure is concentrated by a ratio of between about 1:10 to 1:50, or between about 1:20 and 1:40, or about 1:30.

In an exemplary embodiment, a multiple station tooling assembly 200 is coupled to a press 400, i.e. a one hundred ton press, as noted above. The multiple station tooling assembly 200 includes twenty-four stations or pockets 300. In an embodiment wherein about 8,000 lbfs acts on each pressure surface 521, i.e. on twenty-four pressure surfaces 521, the total load is about 8,000 lbfs*24 (pockets)=192,000 lbfs. About 192,000 lbfs is about 96 tons (192,000 lbfs/2000). Thus, the upper tool assembly 202 with a hybrid bias generating assembly 500 in the configuration described herein solves the stated problem of being usable with existing presses and includes a force concentrating forming surface 600 that is structured to operate with existing one hundred ton presses.

The total bias/force generated by the hybrid bias generating assembly 500 can also be expressed as a "total bias pressure." As used herein, the "total bias pressure" means the total bias/pressure generated by the hybrid bias generating assembly 500, and therefore the upper tool assembly 202. Further, the mechanical bias assembly 550 creates a force which, as used herein, is considered to be evenly distributed over the pressure surface 521. That is, the mechanical force may be treated as a pressure for purposes of calculating the forces and pressure acting on the components. In an exemplary embodiment, the mechanical bias assembly 550 generates between about 70%-80%, or about 75%, of the total bias pressure. Conversely, the pressure generating assembly 510 generates between about 20%-30%, or about 25%, of the total bias pressure. The force/pressure generated by the pressure generating device 512 acts upon the pressure surface 521. In an exemplary embodiment, wherein the pressure surface 521 has an area of about 10.38 $in^2$, the hybrid bias generating assembly 500 generates a pressure of between about 674.4 psi and about 867.1 psi, or about 770.7 psi. Further, in an exemplary embodiment wherein the mechanical bias assembly 550 generates about 75%, of the total bias pressure and the pressure generating assembly 510 generates about 25%, of the total bias pressure, the mechanical bias assembly 550 generates a pressure between about 505.8 psi and about 650.3 psi, or about 578.0 psi, and, the pressure generating assembly 510 generates a pressure between about 168.6 psi and about 216.8 psi, or about 192.7 psi. Further, the pressure generating assembly 510 is structured to pressurize the pressure chamber 516 at a generally constant pressure.

In an alternate exemplary embodiment, the hybrid bias generating assembly 500 is structured to have substantially all, or all, of the total bias pressure generated by the mechanical bias assembly 550 with the pressure generating assembly 510 generating a generally constant, but generally minimal pressure. That is, in this embodiment, the mechanical bias assembly 550 generates between about 90%-99%, or about 95%, of the total bias pressure. Conversely, the pressure generating assembly 510 generates between about 1%-10%, or about 5%, of the total bias pressure. Further, the pressure generating assembly 510 is structured to pressurize the pressure chamber 516 at a generally constant pressure. In this embodiment, the hybrid bias generating assembly 500 is an active hybrid bias generating assembly 502.

Further, in this embodiment, the hybrid bias generating assembly 500 is structured to alter the ratio of force generated by the mechanical bias assembly 550 and the pressure generating assembly 510. That is, for example, during an initial clamping operation, the total bias pressure is substantially generated by the mechanical bias assembly 550, i.e. the mechanical bias assembly 550 generates between about 90%-100%, or about 99%, of the total bias pressure, and, the pressure generating assembly 510 generates between about 0%-10%, or about 5%, of the total bias pressure. After the initial clamping operation, i.e. during a secondary clamping operation, the total bias pressure generated by the mechanical bias assembly 550 is reduced to be greater than, or equal to, 75% of the total bias pressure while the pressure generating assembly 510 generates up to 25%, of the total bias pressure.

In an alternative embodiment, the hybrid bias generating assembly 500 is a selectable hybrid bias generating assembly 504 wherein the user selects the source that generates the pressure, i.e. either the mechanical bias assembly 550 or the pressure generating assembly 510. In this embodiment, the mechanical bias assembly 550 generates between about 99%-100%, or substantially all of the total bias pressure. Conversely, the pressure generating assembly 510 generates between about 0%-1%, or a negligible percentage of the total bias pressure. That is, for example, the pressure generating assembly 510 generates a negligible percentage of the total bias pressure while generating enough pressure to bias elements of the upper tool assembly 202 downwardly during the upstroke. As before, the pressure generating assembly 510 is, in an exemplary embodiment, structured to pressurize the pressure chamber 516 at a generally constant pressure.

In another embodiment, the hybrid bias generating assembly 500 is again a selectable hybrid bias generating assembly 504 wherein the user selects the source that generates the pressure, i.e. either the mechanical bias assembly 550 or the pressure generating assembly 510. In this embodiment, however, the pressure generating assembly 510 generates between about 99%-100%, or substantially all of the total bias pressure. Conversely, the mechanical bias assembly 550 generates between about 0%-1%, or a negligible percentage of the total bias pressure. That is, for example, the mechanical bias assembly 550 generates a negligible percentage of the total bias pressure while generating enough pressure to bias elements of the upper tool assembly 202 downwardly during the upstroke. As before, the pressure generating assembly 510 is, in an exemplary embodiment, structured to pressurize the pressure chamber 516 at a generally constant pressure.

In this embodiment, the pressure generating assembly 510 is structured to apply a variable pressure. That is, the pressure generating assembly 510 includes a pressure control assembly 530 (shown schematically) that is structured to vary the pressure within the pressure chamber 516. The pressure control assembly 530 in an exemplary embodiment, includes a number of pressure sensors (not shown) in the pressure chamber 516 as well as a position sensor (not shown) structured to determine the position of the piston assembly 518. The pressure control assembly 530 is structured to alter the pressure within the pressure chamber 516 according to a pressure profile. That is, the pressure control assembly 530 is structured to increase or decrease the pressure within the pressure chamber 516 depending upon the position of the piston assembly 518. In an exemplary embodiment, the pressure control assembly 530 includes a programmable logic circuit (PLC)(not shown) and a number of electronic pressure regulators. The sensors and electronic pressure regulators are coupled to, and in electronic communication with, the PLC. The PLC further includes instructions for operating the electronic pressure regulators as well as data representing the pressure profile.

In an exemplary embodiment, the hybrid bias generating assembly 500 is structured to be switchable between an active hybrid bias generating assembly 502 or a selectable hybrid bias generating assembly 504, or switchable between different configurations of either an active hybrid bias generating assembly 502 or a selectable hybrid bias generating assembly 504, by virtue of removable springs 552. That is, the springs 552 are removably coupled to the spring seats 554 within the pressure chamber 516. It is noted that, in another embodiment, the upper tool assembly 202 does not include a hybrid bias generating assembly 500, but rather one of a mechanical bias assembly 550 or a pressure generating assembly 510 wherein the selected assembly provides 100% of the total bias pressure. The mechanical bias assembly 550 or the pressure generating assembly 510 is coupled to a "pressure concentrating forming surface" 600 as discussed below. That is, the mechanical bias assembly 550 or the pressure generating assembly 510 is coupled to the other elements described herein.

As noted above, the upper pressure sleeve forming surface 226 is a pressure concentrating forming surface 600. As used herein, a "pressure concentrating forming surface" 600 is a forming surface that engages a reduced area of the blank 2 relative to prior art forming surfaces. That is, prior art forming surfaces clamped the blank 2 disposed over the die core ring upper end's 252 rounded inner surface 256, generally horizontal surface 257 and, in some configurations, the rounded outer surface 258. As used herein, a "pressure concentrating forming surface" 600 is a forming surface that engages a limited portion of the surfaces of die core ring upper end 252, or a limited portion of a crown 14 disposed between the pressure concentrating forming surface 600 and the die core ring upper end 252. That is, a surface that does not "clamp" the blank cannot be part of the "pressure concentrating forming surface" 600. The limited area, in one exemplary embodiment wherein the blank is generally circular, is a radially contiguous annular reduced clamp area. As used herein, a "reduced clamp area" is a radially contiguous annular area extending over a portion of the die core ring upper end's 252 generally horizontal surface 257, but does not extend over the die core ring upper end's 252 rounded inner surface 256. Further, as used herein, a "diminished clamp area" is a radially contiguous annular area extending over about 25-75% of the die core ring upper end's 252 generally horizontal surface 257, but does not extend over the die core ring upper end's 252 rounded inner surface 256. That is, in the known art, the forming surface was generally planar and the entire surface, i.e. 100%, engaged the die core ring upper end 252 and acted as a clamp area, whereas the presently disclosed force concentrating forming surface 600 includes a reduced clamp area.

Figure 9:
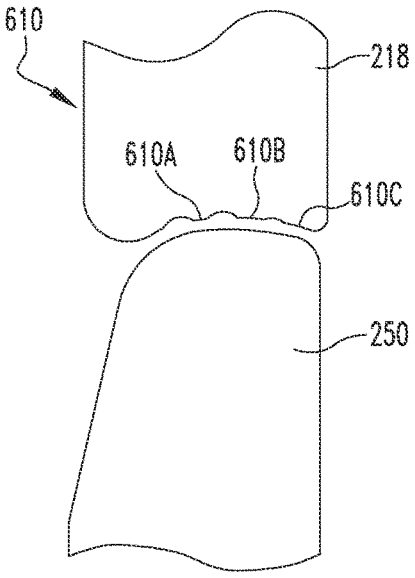
FIG. 9 is a detail side elevation section view of pressure concentrating forming surface with three landings.
Figure 10:
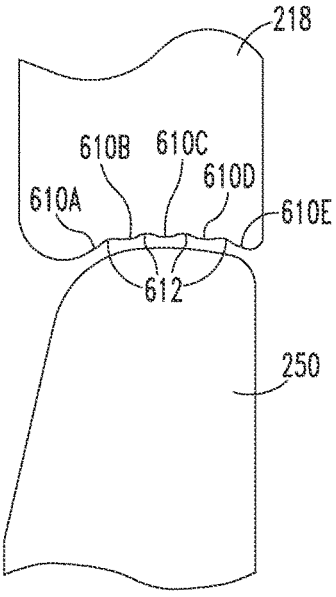
FIG. 10 is a detail side elevation section view of pressure concentrating forming surface with five landings.

In another exemplary embodiment, shown in FIGS. 9 and 10, the pressure concentrating forming surface 600 includes a plurality of "landings" 610. As used herein, a "landing" is a limited area of the upper pressure sleeve forming surface 226. In an exemplary embodiment, the pressure concentrating forming surface plurality of landings 610 includes between two and five substantially concentric landings 610A, 610B, 610C, 610D, 610E. That is, in an exemplary embodiment, the lower end of the upper pressure sleeve 218 includes an annular, i.e. generally circular, forming surface 226. The plurality of landings 610 are concentric portions of the annular forming surface 226 which clamp the blank 2. That is, only the landings 610 engage the blank 2. The areas between the landings 610 are upwardly offset relative to the landings 610 so that these areas do not engage the blank 2. Stated alternately, in an exemplary embodiment, there are concentric grooves 612 between the landings 610.

As shown in FIG. 7, the upper pressure sleeve forming surface 226 has a cross-sectional area that is much smaller than the cross-sectional area of the piston assembly 518 and/or the lower spring seat 554'. In this configuration, the pressure/area applied to the blank 2 by the upper pressure sleeve forming surface 226 is greater than the pressure/area acting on the piston assembly 518 and/or the lower spring seat 554'. That is, while the bias/force remains constant, the area upon which the bias/force acts is greater at the piston assembly 518 and/or the lower spring seat 554' compared to the area at the upper pressure sleeve forming surface 226. Thus, as the area at the upper pressure sleeve forming surface 226 is smaller, the pressure per unit of area is greater.

The increase in pressure per a unit of area is greater for a pressure concentrating forming surface 600. That is, the area of a pressure concentrating forming surface 600, as defined herein, is even smaller than the area upper pressure sleeve forming surface 226. In an exemplary embodiment, using a pressure concentrating forming surface 600, the ratio of the total bias pressure to the clamping pressure is between about 1:10 to 1:50 or between about 1:20 and 1:40, or about 1:30.

In this configuration, the clamping pressure is, in an exemplary embodiment, about at the elastic limit of the material being deformed. Moreover, in an exemplary embodiment, the material being deformed has a "thinning limit." That is, as used herein, a "thinning limit" is the elastic limit of the material while under compression. That is, a material under compression may be placed under tension that exceeds the elastic limit of the material without tearing the material. Thus, as used herein, the "thinning limit" is pressure that allows the material to thin by about 10% without tearing. The exemplary measurements above, e.g. the area of pressure surface 521, are for a tooling assembly 200 working on aluminum that is initially about 0.0082 inch thick. The pressure concentrating forming surface 600 is structured to generate a clamping pressure that is about at the thinning limit of aluminum and to thin the aluminum so that the thickness of the material in the chuck wall 12 may be reduced to a thickness of about 0.0074 inch.

Figure 11:
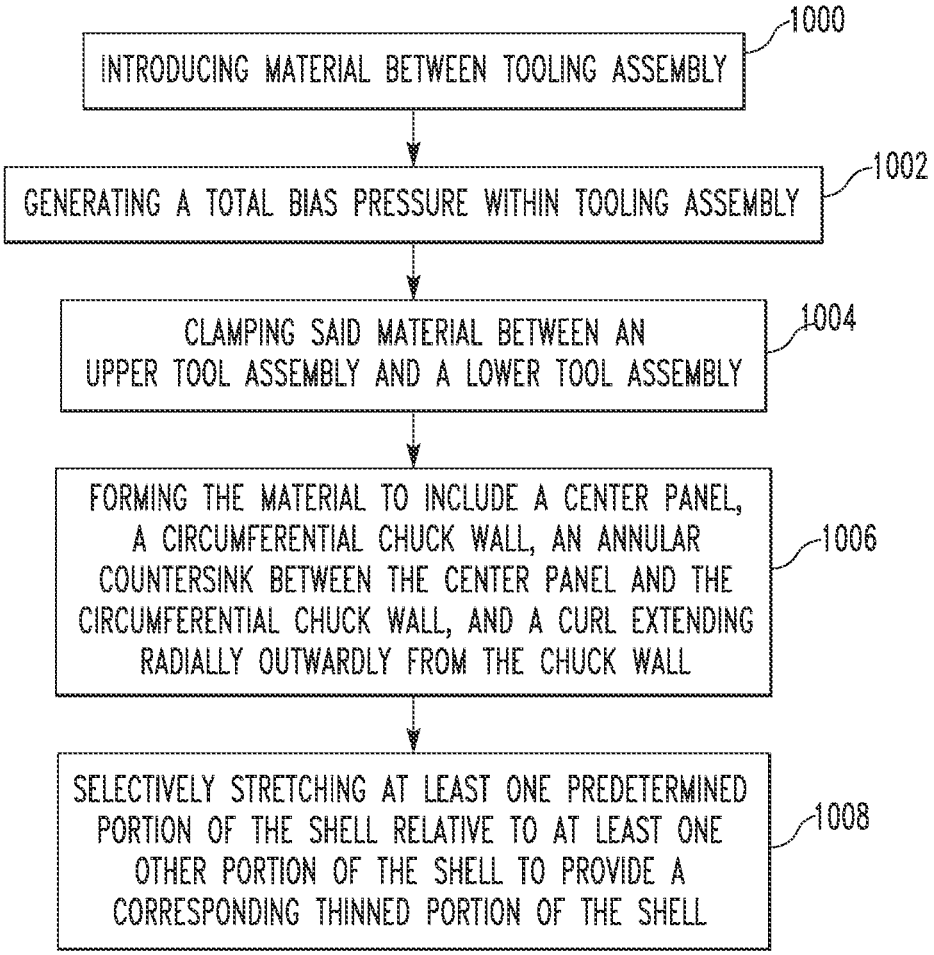
FIG. 11 is a flow chart of a disclosed method.
Figure 12A:
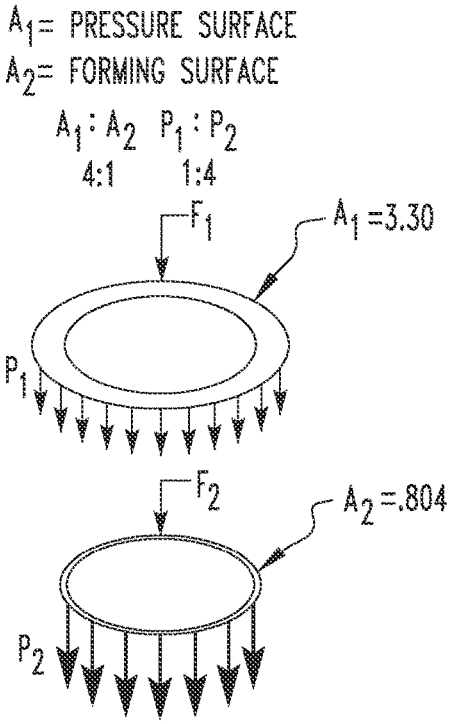
FIG.12A (PRIOR ART)
FIG. 12A is a schematic representation of the force, pressure, and selected component areas associated with the prior art wherein there is a 1:4 ratio of pressure on the upper piston to lower clamp surface pressure on material.
Figure 12B:
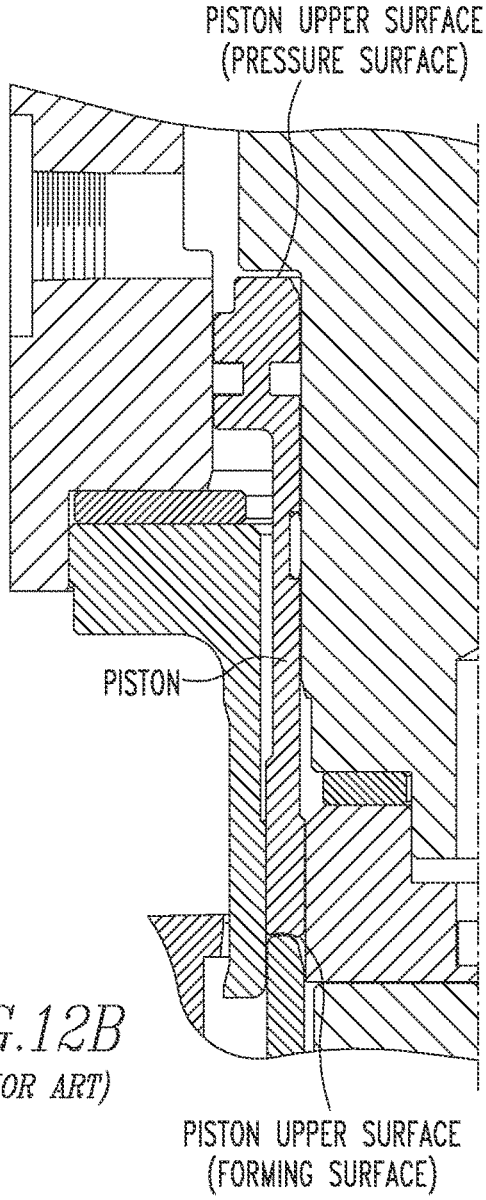
FIG.12B (PRIOR ART)
FIG. 12B is a partial cross-sectional side view of a prior art tooling capable of the 1:4 pressure ratio.
Figure 13A:
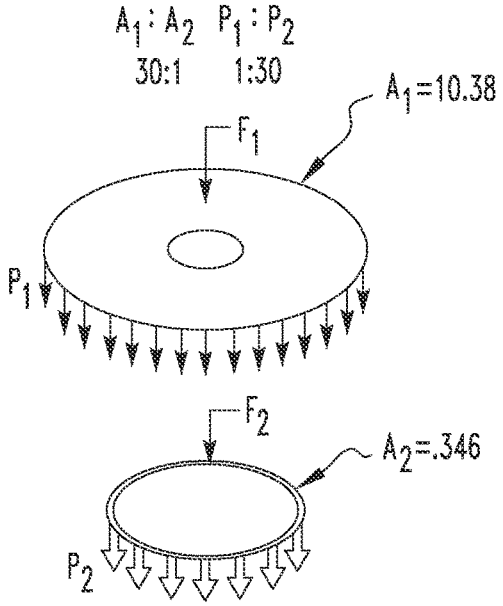
FIG. 13A is a schematic representation of the force, pressure, and selected component areas associated with the disclosed concept wherein there is a 1:30 ratio of pressure on the upper piston to lower clamp surface pressure on material.
Figure 13B:
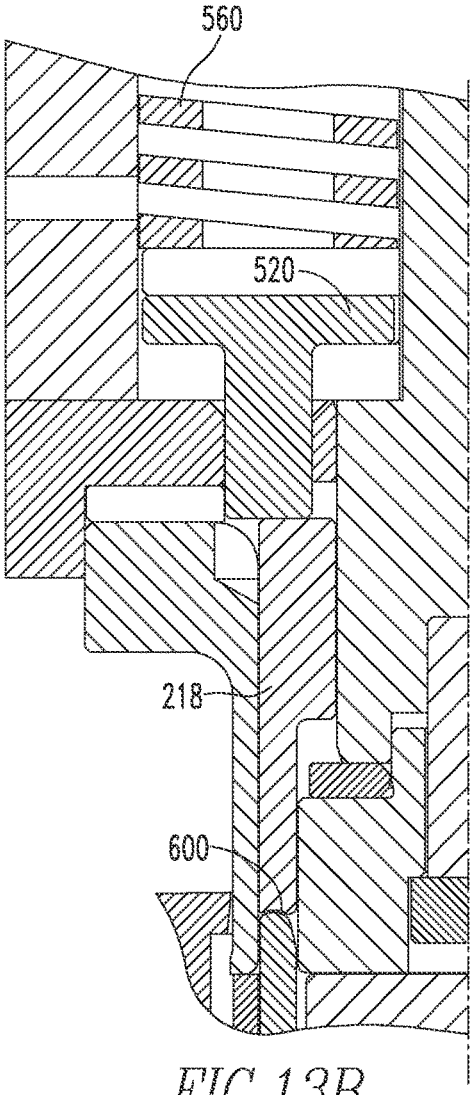
FIG. 13B is a partial cross-sectional side view of the tooling shown in FIG. 3 and capable of the 1:30 pressure ratio.

Accordingly, as shown in FIG. 11, use of the tooling assembly 200A described above includes introducing 1000 material between tooling assembly 200A, generating 1002 a total bias force within the tooling assembly 200A, clamping 1004 the material between an upper tool assembly 202 and a lower tool assembly 204, forming 1006 the material to include a center panel, a circumferential chuck wall, an annular countersink between the center panel and the circumferential chuck wall, and a curl extending radially outwardly from the chuck wall, and selectively stretching 1008 at least one predetermined portion of the shell relative to at least one other portion of the shell to provide a corresponding thinned portion of the shell.

It is noted that the method and assemblies for thinning a shell disclosed herein may also be used to thin the metal thickness on a can body, a can end and/or dome as well as on a cup, i.e. a precursor construct for a can body.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. Tooling for forming a shell, the tooling comprising:

an upper tool assembly including an upper pressure sleeve;

the upper pressure sleeve including a lower end defining a pressure concentrating forming surface;

a lower tool assembly cooperating with the upper tool assembly to form material disposed therebetween to include a center panel, a circumferential chuck wall, an annular countersink between the center panel and the circumferential chuck wall, and a curl extending radially outwardly from the chuck wall;

wherein the upper tool assembly and the lower tool assembly move between a separated, first position, wherein the upper tool assembly is spaced from the lower tool assembly, and a forming position, wherein the upper tool assembly is immediately adjacent the lower tool assembly to selectively stretch the material of at least one predetermined portion of the shell relative to at least one other portion of the shell, thereby providing a corresponding thinned portion;

wherein the pressure concentrating forming surface includes a reduced clamp area; and wherein the pressure concentrating forming surface includes a plurality of landings.

2. The tooling of claim 1 wherein the pressure concentrating forming surface plurality of landings includes between two and five substantially concentric landings.

3. Tooling for forming a shell, the tooling comprising:

an upper tool assembly including an upper pressure sleeve;

the upper pressure sleeve including a lower end defining a pressure concentrating forming surface;

a lower tool assembly cooperating with the upper tool assembly to form material disposed therebetween to include a center panel, a circumferential chuck wall, an annular countersink between the center panel and the circumferential chuck wall, and a curl extending radially outwardly from the chuck wall;

wherein the upper tool assembly and the lower tool assembly move between a separated, first position, wherein the upper tool assembly is spaced from the lower tool assembly, and a forming position, wherein the upper tool assembly is immediately adjacent the lower tool assembly to selectively stretch the material of at least one predetermined portion of the shell relative to at least one other portion of the shell, thereby providing a corresponding thinned portion;

wherein the pressure concentrating forming surface includes a reduced clamp area;

the upper tool assembly includes an upper die shoe, a riser body, and a hybrid bias generating assembly;

the riser body coupled to the die shoe, the riser body defining a pressure chamber;

the upper pressure sleeve movably disposed in the riser body pressure chamber;

the upper pressure sleeve movable between an extended, first position, wherein the upper pressure sleeve lower end is more spaced from the upper die shoe, and a retracted, second position, wherein the upper pressure sleeve lower end is less spaced from the upper die shoe;

the hybrid bias generating assembly operatively coupled to the upper pressure sleeve;

wherein the hybrid bias generating assembly controls the movement of the upper pressure sleeve as the upper tool assembly and the lower tool assembly move between the first and second positions;

wherein the hybrid bias generating assembly includes a pressure generating assembly, a mechanical bias assembly, and a number of hybrid components;

the pressure generating assembly is structured to pressurize the pressure chamber;

the mechanical bias assembly includes a number of springs;

the hybrid bias generating assembly generates a total bias force as the upper tool assembly and the lower tool assembly move between the first and second positions;

wherein the pressure generating assembly generates between about 20%-30% of the total bias force; and wherein the mechanical bias assembly generates between about 70%-80% of the total bias force.

4. The tooling of claim 3 wherein:

the pressure generating assembly generates about 25% of the total bias force; and the mechanical bias assembly generates about 75% of the total bias force.

5. Tooling for forming a shell, the tooling comprising:

an upper tool assembly including an upper pressure sleeve;

the upper pressure sleeve including a lower end defining a pressure concentrating forming surface;

a lower tool assembly cooperating with the upper tool assembly to form material disposed therebetween to include a center panel, a circumferential chuck wall, an annular countersink between the center panel and the circumferential chuck wall, and a curl extending radially outwardly from the chuck wall;

wherein the upper tool assembly and the lower tool assembly move between a separated, first position, wherein the upper tool assembly is spaced from the lower tool assembly, and a forming position, wherein the upper tool assembly is immediately adjacent the lower tool assembly to selectively stretch the material of at least one predetermined portion of the shell relative to at least one other portion of the shell, thereby providing a corresponding thinned portion;

wherein the pressure concentrating forming surface includes a reduced clamp area;

the upper tool assembly includes an upper die shoe, a riser body, and a hybrid bias generating assembly;

the riser body coupled to the die shoe, the riser body defining a pressure chamber;

the upper pressure sleeve movably disposed in the riser body pressure chamber;

the upper pressure sleeve movable between an extended, first position, wherein the upper pressure sleeve lower end is more spaced from the upper die shoe, and a retracted, second position, wherein the upper pressure sleeve lower end is less spaced from the upper die shoe;

the hybrid bias generating assembly operatively coupled to the upper pressure sleeve;

wherein the hybrid bias generating assembly controls the movement of the upper pressure sleeve as the upper tool assembly and the lower tool assembly move between the first and second positions;

wherein the hybrid bias generating assembly includes a pressure generating assembly, a mechanical bias assembly, and a number of hybrid components;

the pressure generating assembly is structured to pressurize the pressure chamber;

the mechanical bias assembly includes a number of springs;

the hybrid bias generating assembly generates a total bias force as the upper tool assembly and the lower tool assembly move between the first and second positions;

wherein the total bias force is communicated through the upper pressure sleeve to the pressure concentrating forming surface;

wherein the pressure concentrating forming surface is structured to apply a clamping force to a work piece; and wherein the ratio of the total bias force to the clamping force is between about 1:20 and 1:40.

6. The tooling of claim 5 wherein the ratio of the total bias force to the clamping force is about 1:30.

7. Tooling for forming a shell, the tooling comprising:

an upper tool assembly including an upper pressure sleeve;

the upper pressure sleeve including a lower end defining a pressure concentrating forming surface;

a lower tool assembly cooperating with the upper tool assembly to form material disposed therebetween to include a center panel, a circumferential chuck wall, an annular countersink between the center panel and the circumferential chuck wall, and a curl extending radially outwardly from the chuck wall;

wherein the upper tool assembly and the lower tool assembly move between a separated, first position, wherein the upper tool assembly is spaced from the lower tool assembly, and a forming position, wherein the upper tool assembly is immediately adjacent the lower tool assembly to selectively stretch the material of at least one predetermined portion of the shell relative to at least one other portion of the shell, thereby providing a corresponding thinned portion;

wherein the pressure concentrating forming surface includes a reduced clamp area;

the upper tool assembly generates a total bias force as the upper tool assembly and the lower tool assembly move between the first and second positions;

wherein the total bias force is communicated through the upper pressure sleeve to the pressure concentrating forming surface;

wherein the pressure concentrating forming surface is structured to apply a clamping force to a work piece; and wherein the ratio of the total bias force to the clamping force is between about 1:20 and 1:40.

8. The tooling of claim 7 wherein the ratio of the total bias force to the clamping force is between about 1:30.

9. A method for forming a shell comprising:

introducing material between tooling;

generating a total bias force within the tooling;

clamping the material between an upper tool assembly and a lower tool assembly, wherein the ratio of the total bias force to the clamping force is between about 1:20 and 1:40;

forming the material to include a center panel, a circumferential chuck wall, an annular countersink between the center panel and the circumferential chuck wall, and a curl extending radially outwardly from the chuck wall; and selectively stretching at least one predetermined portion of the shell relative to at least one other portion of the shell to provide a corresponding thinned portion of the shell.

10. The method of claim 9 wherein the clamping the material between an upper tool assembly and a lower tool assembly includes the ratio of the total bias force to the clamping force of about 1:30.

* * * * *